US007584684B2

(12) United States Patent
Shibui et al.

(10) Patent No.: US 7,584,684 B2
(45) Date of Patent: Sep. 8, 2009

(54) MAN-POWERED BRAKING APPARATUS

(75) Inventors: Naoto Shibui, Saitama (JP); Fumikage Yamanaka, Saitama (JP); Takahiko Midori, Saitama (JP); Satoru Masuda, Kanagawa (JP)

(73) Assignees: Honda Giken Kogyo Kabushiki Kaisha, Tokyo (JP); Otsuka Koki Kabushiki Kaisha, Kanagawa (JP)

( * ) Notice: Subject to any disclaimer, the term of this patent is extended or adjusted under 35 U.S.C. 154(b) by 694 days.

(21) Appl. No.: 11/116,355

(22) Filed: Apr. 28, 2005

(65) Prior Publication Data

US 2005/0252333 A1 Nov. 17, 2005

(30) Foreign Application Priority Data

May 12, 2004 (JP) ..... 2004-142301

(51) Int. Cl.
*G05G 1/30* (2008.04)

(52) U.S. Cl. ..... 74/560

(58) Field of Classification Search ..... 74/478, 74/490.12, 490.14, 500.5, 512, 527, 529, 74/532, 533, 535, 560, 577 R
See application file for complete search history.

(56) References Cited

U.S. PATENT DOCUMENTS 4,519,270 A * 5/1985 Kawaguchi et al. ..... 74/535
5,217,094 A * 6/1993 Walter et al. ..... 188/2 D
5,758,547 A * 6/1998 Smale ..... 74/516
6,736,025 B2 * 5/2004 Kanbe ..... 74/535
7,337,694 B2 * 3/2008 Ninomiya et al. ..... 74/542

FOREIGN PATENT DOCUMENTS

JP 05-331378 12/1993

* cited by examiner

*Primary Examiner*—Vicky A Johnson
(74) *Attorney, Agent, or Firm*—Kubotera & Associates, LLP

(57) ABSTRACT

A man-powered braking apparatus which uses rocking motion to switch over between the braking state and the releasing state, assures smooth operation, and minimizes the reduction in braking force when the braking lever is returned. When the force to the braking lever 20 is removed, the braking state in which the pawl member 40 is engaged with the ratchet plate 12 is maintained. When the force is removed, the power transmission pin 25 is moved, being kept fitted into the cam groove 52 in the transmission link member 50, and is shifted from the force transmission cam groove 53 to the release holding cam groove 54, the transmission link member 50 being turned to the releasing position, and the pawl member 40 is brought into the state in which it is energized in the direction for being disengaged from the ratchet plate 12 while the braking state being maintained. Then, when a force is once applied to the braking lever 20 for releasing the brake, the pawl member 40 is disengaged from the teeth 12*a* of said ratchet plate 12; and then when the force is removed, the braking lever 20 and the output link member 30 are turned in the brake releasing direction for releasing the brake.

11 Claims, 11 Drawing Sheets

MAN-POWERED BRAKING APPARATUS

FIELD OF THE INVENTION

The present invention relates to a man-powered braking apparatus with which the base part of a braking lever is rockably pivoted to a base fixed to a car body; the end part of the braking lever is extended to the vicinity of the operator; and brake is applied by exerting a force on the end part thereof for pulling a braking cable in accordance with turning of the braking lever.

BACKGROUND

For example, as a man-powered braking apparatus, such as a treadle-powered type parking brake, a system with which the base part of a braking lever is rockably pivoted to a base fixed to a car body; the end part of the braking lever is extended to the vicinity of the operator; and brake is applied by exerting a force on the end part thereof for pulling a braking cable in accordance with turning of the braking lever is known.

As such a conventional man-powered braking apparatus, that as disclosed in Japanese Laid-Open Publication No. 7-186909.

In Japanese Laid-Open Publication No. 7-186909, the art wherein a lock mechanism of internal tooth ratchet type which holds the braking link in the braking state when the braking lever is treaded from the non-braking state, and then released, and releases the brake holding state when the braking lever is again treaded, and a sliding plate is used for releasing the brake holding state.

However, with such a prior art, the sliding plate is displaced to switch over between the braking state and the releasing state, which results in a high sliding resistance, and use of the sliding displacement makes it difficult to reduce the amount of displacement, which involves a proportionately great reduction in braking force.

Being developed in consideration of such problems of the prior art, the purpose of the present invention is to provide a man-powered braking apparatus which uses rocking motion to switch over between the braking state and the releasing state, assures smooth operation, and minimizes the reduction in braking force when the braking lever is returned.

SUMMARY OF THE INVENTION

The subject matters of the present invention to achieve the above purpose are disclosed in the following items:

[1] A man-powered braking apparatus (1) with which the base part (21) of a braking lever (20) is rockably pivoted to a base (10) fixed to a car body; the end part (23) of the braking lever (20) is extended to the vicinity of the operator; and brake is applied by exerting a force on the end part (23) thereof for pulling a braking cable (C) in accordance with turning of the braking lever (20), wherein an output link member (30) to which the braking cable (C) is connected is pivoted to said base (10) coaxially with said braking lever (20); a pawl member (40) which is engaged with teeth (12*a*) of a ratchet plate (12) fixedly installed to said base (10) to maintain the braking state is pivoted to the output link member (30); a transmission link member (50) is disposed between said braking lever (20) and said output link member (30);

said output link member (30) is pushed by the base part (21) of said braking lever (20) through said transmission link member (50), being turned in one direction from the non-braking position to pull the braking cable (C) connected to the output link member (30) for generation of a braking force;

said transmission link member (50) is pivoted to said output link member (30) such that it is capable of being rocked between the braking position and the releasing position, and has a cam groove (52) which is fitted with a power transmission pin (25) fixedly installed to the base part (21) of said braking lever (20);

said pawl member (40) is capable of being kept energized by a turnover spring (45) disposed between it and said transmission link member (50) in the direction for being engaged with or disengaged from the teeth (12*a*) of said ratchet plate (12);

the cam groove (52) in said transmission link member (50) has a force transmission cam groove (53) which is formed such that, when the transmission link member (50) is in the braking position, the force which is applied to the end part (23) of said braking lever (20) can be transmitted to said output link member (30), and a release holding cam groove (54) which, when the force applied to said braking lever (20) is removed, and the braking lever (20) is returned by a return spring (26), causes said transmission link member (50) to be turned to the releasing position, and said turnover spring (45), which has energized said pawl member (40) in the direction for being engaged with the teeth (12*a*) of said ratchet plate (12), to be inverted such that said pawl member (40) is energized in the direction for being disengaged from the teeth (12*a*) of said ratchet plate (12);

when a force is applied to the end part (23) of said braking lever (20) for pulling the braking cable (C) in accordance with turning of the braking lever (20) to operate the brake, and then the force is removed, the pawl member (40) engages with the teeth (12*a*) of the ratchet plate (12) to maintain the braking state; when the braking lever (20) is displaced in the returning direction by the return spring (26), the pawl member (40) is brought into the state in which it is energized in the direction for being disengaged from the teeth (12*a*) of said ratchet plate (12) while the braking state being maintained; then, when a force is once applied to the braking lever (20) for releasing the brake, the pawl member (40) is disengaged from the teeth (12*a*) of said ratchet plate (12); and then when the force is removed, the braking lever (20) and said output link member (30) are turned in the brake releasing direction for releasing the brake.

[2] A man-powered braking apparatus (1) with which the base part (21) of a braking lever (20) is rockably pivoted to a base (10) fixed to a car body; the end part (23) of the braking lever (20) is extended to the vicinity of the operator; and brake is applied by exerting a force on the end part (23) thereof for pulling a braking cable (C) in accordance with turning of the braking lever (20), wherein an output link member (30) to which the braking cable (C) is connected is pivoted to said base (10) coaxially with said braking lever (20); a pawl member (40) which is engaged with teeth (12*a*) of a ratchet plate (12) fixedly installed to said base (10) to maintain the braking state is pivoted to the output link member (30); a transmission link member (50) disposed between said braking lever (20) and said output link member (30) is pivoted to the output link member (30) coaxially with the pawl member (40);

said output link member (30) is pushed by the base part (21) of said braking lever (20) through said transmission link member (50), being turned in one direction from the non-braking position to pull the braking cable (C) connected to the output link member (30), being wound thereon, for generation of a braking force;

said transmission link member (50) is pivoted to said output link member (30) such that it is capable of being rocked between the braking position and the releasing position, and has a cam groove (52) which is fitted with a power transmission pin (25) fixedly installed to the base part (21) of said braking lever (20);

said pawl member (40) is capable of being kept energized by a turnover spring (45) disposed between it and said transmission link member (50) in the direction for being engaged with or disengaged from the teeth (12*a*) of said ratchet plate (12);

the cam groove (52) in said transmission link member (50) has a force transmission cam groove (53) which is formed such that, when the transmission link member (50) is in the braking position, the force which is applied to the end part (23) of said braking lever (20) can be transmitted to said output link member (30), and a release holding cam groove (54) which, when the force applied to said braking lever (20) is removed, and the braking lever (20) is returned by a return spring (26), causes said transmission link member (50) to be turned to the releasing position, and said turnover spring (45), which has energized said pawl member (40) in the direction for being engaged with the teeth (12*a*) of said ratchet plate (12), to be inverted such that said pawl member (40) is energized in the direction for being disengaged from the teeth (12*a*) of said ratchet plate (12);

when a force is applied to the end part (23) of said braking lever (20) for pulling the braking cable (C) in accordance with turning of the braking lever (20) to operate the brake, and then the force is removed, the pawl member (40) engages with the teeth (12*a*) of the ratchet plate (12) to maintain the braking state; when the braking lever (20) is displaced in the returning direction by the return spring (26), the pawl member (40) is brought into the state in which it is energized in the direction for being disengaged from the teeth (12*a*) of said ratchet plate (12) while the braking state being maintained; then, when a force is once applied to the braking lever (20) for releasing the brake, the pawl member (40) is disengaged from the teeth (12*a*) of said ratchet plate (12); then when the force is removed, the braking lever (20) and said output link member (30) are turned in the brake releasing direction for releasing the brake; and then when the braking lever (20) is returned to the original position, said transmission link member (50) is butted against a part of said base (10), being also returned to the original position.

[3] The man-powered braking apparatus (1) of item [1] or [2], wherein an assist spring (55) is provided for turning said transmission link member (50) to the releasing position.

[4] The man-powered braking apparatus (1) of item [1] or [2], wherein said braking lever (20) is that with which a force is applied by treading on the end part (23).

Said present invention functions as follows:

By applying a force to the end part (23) of the braking lever (20) which base part (21) is pivoted to the base (10) fixed to a car body, the output link member (30) is turned in one direction from the non-braking position in accordance with turning of the braking lever (20), being pushed by the base part (21) of the braking lever (20) through the transmission link member (50), and thus the braking cable (C) connected to the output link member (30) can be pulled to generate a braking force.

In other words, when a force is applied to the end part (23) of the braking lever (20), the force is transmitted from the power transmission pin (25) fixedly installed to the base part (21) of the braking lever (20) to the force transmission cam groove (53) of the cam groove (52) in the transmission link member (50), and the force is transmitted to the output link member (30) to which the braking cable (C) is connected, the output link member (30) being turned with the braking cable (C) being pulled.

When the output link member (30) is turned, the pawl member (40), which is pivoted to the output link member (30), is moved, being kept engaged with the teeth (12*a*) of the ratchet plate (12), which is fixedly installed to the base (10). Then, in a position where a moderate braking force is provided, removing the force from the end part (23) of the braking lever (20) to release it will cause the pawl member (40) to be kept engaged with the teeth (12*a*) at that position for preventing the output link member (30) from being returned, and thus maintaining the braking state.

The transmission link member (50) is pivoted to the output link member (30) such that it is capable of being rocked between the braking position and the releasing position, and when a force is applied to the end part (23) of the braking lever (20), the transmission link member (50) is in the braking position. When the braking lever (20) is released, the braking lever (20) is returned toward the releasing position by the force of the return spring (26). And the power transmission pin (25) fixedly installed to the base part (21) of the braking lever (20) is moved, being kept fitted into the cam groove (52) in the transmission link member (50), and is shifted from the force transmission cam groove (53) to the release holding cam groove (54). The braking lever (20) is returned by the amount corresponding to the play for this shift, however, by providing the cam groove (52) with an appropriate geometry, the play can be minimized.

The pawl member (40) is capable of being kept energized by the turnover spring (45) disposed between it and the transmission link member (50) in the direction for being engaged with or disengaged from the teeth (12*a*) of the ratchet plate (12), and when a force has been applied to the end part (23) of the braking lever (20) for the first time, the pawl member (40) is energized in the direction for being engaged with the teeth (12*a*) of the ratchet plate (12).

When the force applied to the braking lever (20) is removed, the braking lever (20) being returned by the return spring (26), the power transmission pin (25) for the braking lever (20) is moved, being kept fitted into the cam groove (52) in the transmission link member (50), and is shifted from the force transmission cam groove (53) to the release holding cam groove (54), the transmission link member (50) being turned to the releasing position, and the turnover spring (45), which has energized the pawl member (40) in the direction for being engaged with the teeth (12*a*) of the ratchet plate (12), is inverted such that the pawl member (40) is energized in the direction for being disengaged from the teeth (12*a*) of the ratchet plate (12). When the pawl member (40) is engaged with the teeth (12*a*) of the ratchet plate (12) by the braking force, the pawl member (40) will not be disengaged, being held by the friction force, even if the direction in which the pawl member (40) is energized is inverted.

Thus, when a force is applied to the end part (23) of the braking lever (20), the braking lever (C) being pulled in accordance with turning of the braking lever (20) for braking, and then the force is removed, the pawl member (40) is engaged with the teeth (12*a*) of the ratchet plate (12) to maintain the braking state, and when the braking lever (20) is displaced in the returning direction by the return spring (26), the pawl member (40) is brought into the state in which it is energized in the direction for being disengaged from the teeth (12*a*) of the ratchet plate (12) while the braking state being maintained.

Then, when a force is once applied to the braking lever (20) for releasing the brake from the braking state, the pawl member (40) is disengaged from the teeth (12*a*) of the ratchet plate (12) by the energizing force of the inverted turnover spring (45), then, removing the force at that point allows the braking lever (20) and the output link member (30) to be turned in the brake releasing direction for releasing the brake. When the braking lever (20) is returned to the original position, the transmission link member (50) is butted against a part of the base (10), the transmission link member (50) being also returned to the braking position as the original position.

In one embodiment in which the braking cable (C) is connected to the output link member (30), being wound thereon, the braking cable (C) is smoothly pulled by the circumference of the output link member (30) for generation of the braking force. In one embodiment in which the transmission link member (50) is pivoted to the output link member (30) coaxially with the pawl member (40), the linking is simplified, which results in easier layout. In one embodiment in which an assist spring (55), which causes the transmission link member (50) to be turned to the releasing position, is provided, the transmission link member (50) is positively turned from the braking position to the releasing position. In one embodiment in which the braking lever (20) is of treadle-powered type, foot, which is rather inconvenient, as compared to hand, can be used to apply a force to the end part (23) for the proper operation of the man-powered braking apparatus (1).

DETAILED DESCRIPTION OF THE INVENTION

Figure 1:
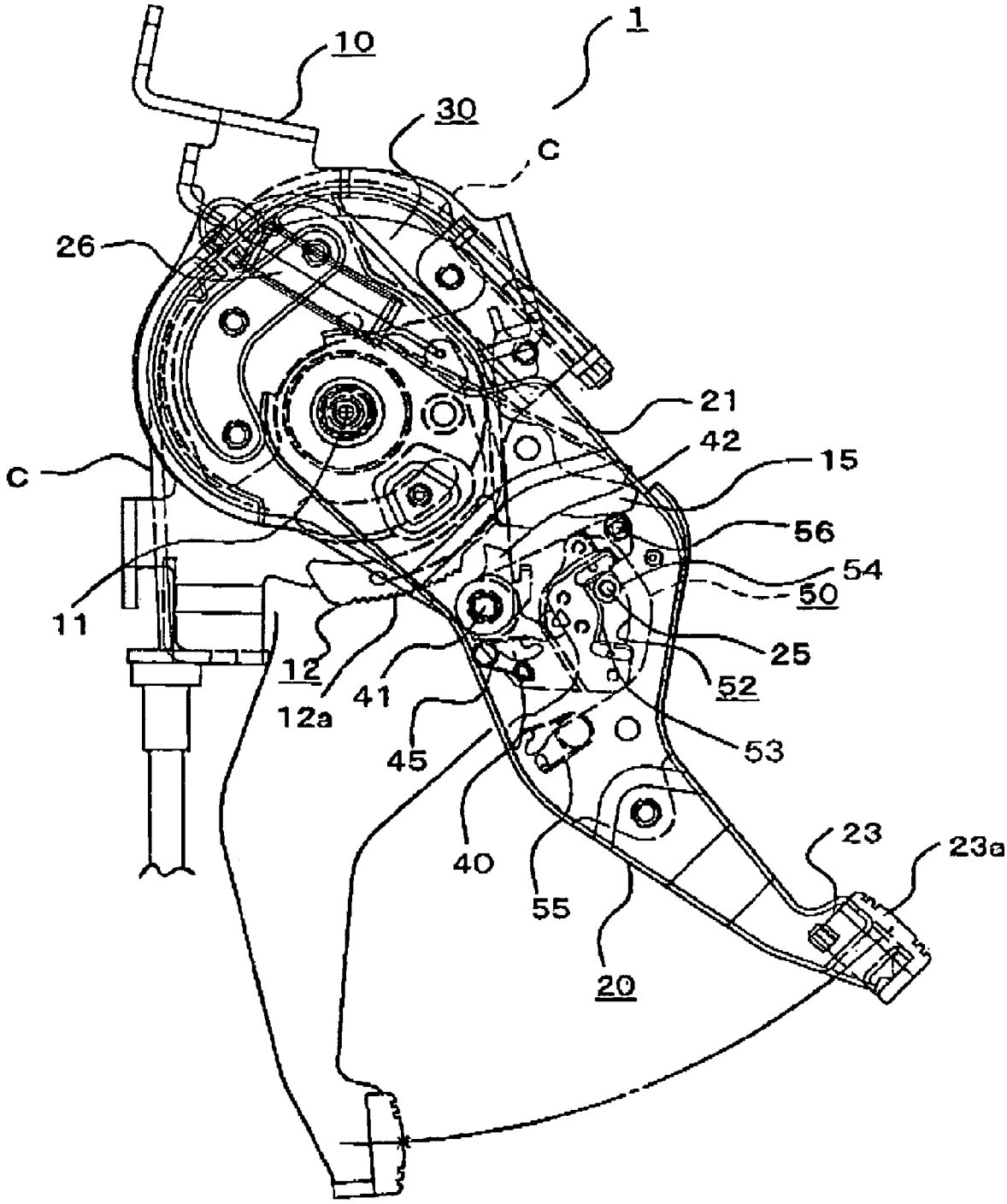
FIG. 1 is a side view illustrating a man-powered braking apparatus according to one embodiment of the present invention.
Figure 2:
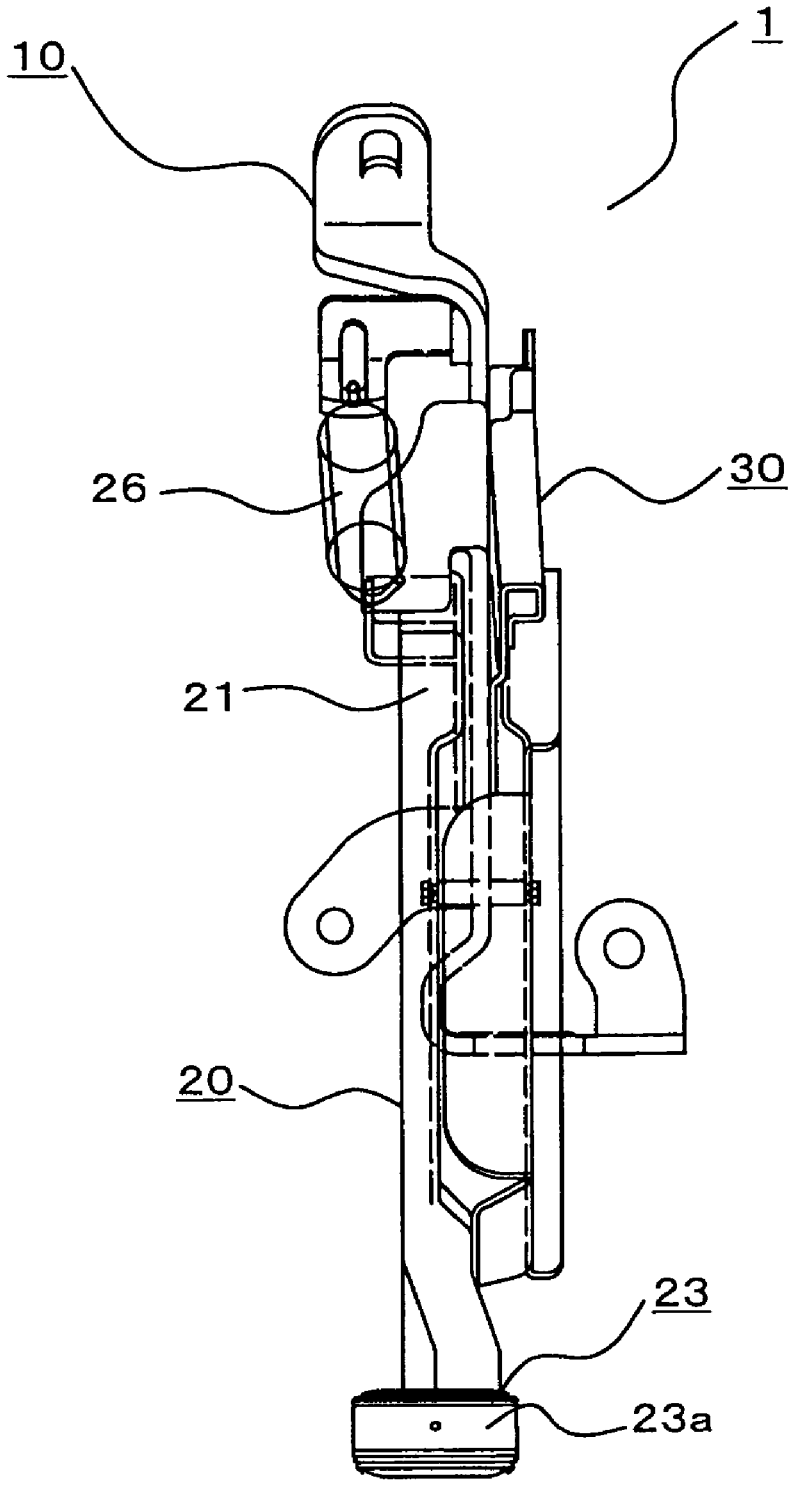
FIG. 2 is a front view illustrating a man-powered braking apparatus according to one embodiment of the present invention.

Hereinbelow, an exemplary embodiment of the present invention will be described with reference to the drawings.

FIG. 1 to FIG. 11 show an embodiment of the present invention.

With a man-powered braking apparatus 1, the base part 21 of a braking lever 20 is rockably pivoted to a base 10 fixed to a car body by a main support shaft 11, and the end part 23 of the braking lever 20 is extended to the vicinity of the operator. Brake is applied by exerting a force on a toe shoe 23*a* in the end part 23 for pulling a braking cable C in accordance with turning of the braking lever 20. In the present embodiment, the braking lever 20 is of treadle-powered type, which permits a force to be applied by treading on the toe shoe 23*a* in the end part 23, but the braking lever 20 may be adapted to be operated by hand.

An output link member 30 to which the braking cable C is connected, being wound thereon, is pivoted to the base 10 coaxially with the braking lever 20 by means of the main support shaft 11; a pawl member 40 which is engaged with teeth 12*a* of a ratchet plate 12 fixedly installed to the base 10 to maintain the braking state is pivoted to the output link member 30 by means of a pivot pin 41; and a transmission link member 50 disposed between the braking lever 20 and the output link member 30 is pivoted to the output link member 30 coaxially with the pawl member 40 by means of the pivot pin 41. A coaxial design is not a must, but it renders the construction simpler.

The output link member 30 is pushed by the base part 21 of the braking lever 20 through the transmission link member 50, being turned in one direction from the non-braking position to pull the braking cable C connected to the output link member 30, being wound thereon, for generation of a braking force. The braking cable C may be simply connected to the output link member 30 without being wound thereon.

The transmission link member 50 is pivoted to the output link member 30 by the pivot pin 41 such that it is capable of being rocked between the braking position and the releasing position, and has a cam groove 52 which is fitted with a power transmission pin 25 fixedly installed to the base part 21 of the braking lever 20.

The pawl member 40 is supported such that it is capable of being kept energized by a turnover spring 45 disposed between it and the transmission link member 50 in the direction for a pawl end 42 being engaged with or disengaged from the teeth 12*a* of the ratchet plate 12.

The cam groove 52 in the transmission link member 50 has a force transmission cam groove 53 which is formed such that, when the transmission link member 50 is in the braking position, a force which is applied to the toe shoe 23*a* in the end part 23 of the braking lever 20 can be transmitted to the output link member 30, and a release holding cam groove 54 which, when the force applied to the braking lever 20 is removed, and the braking lever 20 is returned by a return spring 26, causes the transmission link member 50 to be turned to the releasing position, and the turnover spring 45, which has energized the pawl member 40 in the direction for being engaged with the teeth 12*a* of the ratchet plate 12, to be inverted such that the pawl member 40 is energized in the direction for being disengaged from the teeth 12*a* of the ratchet plate 12.

The man-powered braking apparatus 1 is configured such that, even when a force is applied to the toe shoe 23*a* in the end part 23 of the braking lever 20 for pulling the braking cable C in accordance with turning of the braking lever 20 to operate the brake, and then the force is removed, the pawl end 42 of the pawl member 40 engages with the teeth 12*a* of the ratchet plate 12 to maintain the braking state.

When the braking lever 20 is displaced in the returning direction by the return spring 26, the pawl member 40 is brought into the state in which it is energized in the direction for being disengaged from the teeth 12*a* of the ratchet plate 12 while the braking state being maintained; then, when a force is once applied to the braking lever 20 for releasing the brake, the pawl end 42 of the pawl member 40 is disengaged from the teeth 12*a* of the ratchet plate 12; then when the force is removed, the braking lever 20 and the output link member 30 are turned in the brake releasing direction for releasing the brake; and then when the braking lever 20 is returned to the original position, a return pin 56 of the transmission link member 50 is butted against a return end 15 formed as a part of the base 10, the transmission link member 50 also being returned to the original position.

In addition, an assist spring 55, which causes the transmission link member 50 to be turned from the braking position to the releasing position, is provided.

Next, the function will be described.

By treading on the toe shoe 23*a* in the end part 23 of the braking lever 20 which base part 21 is pivoted to the base 10 fixed to a car body, the output link member 30 is turned in one direction from the non-braking position in accordance with turning of the braking lever 20, being pushed by the base part 21 of the braking lever 20 through the transmission link member 50, and thus the braking cable C connected to the output link member 30 can be pulled to generate a braking force.

Figure 3:
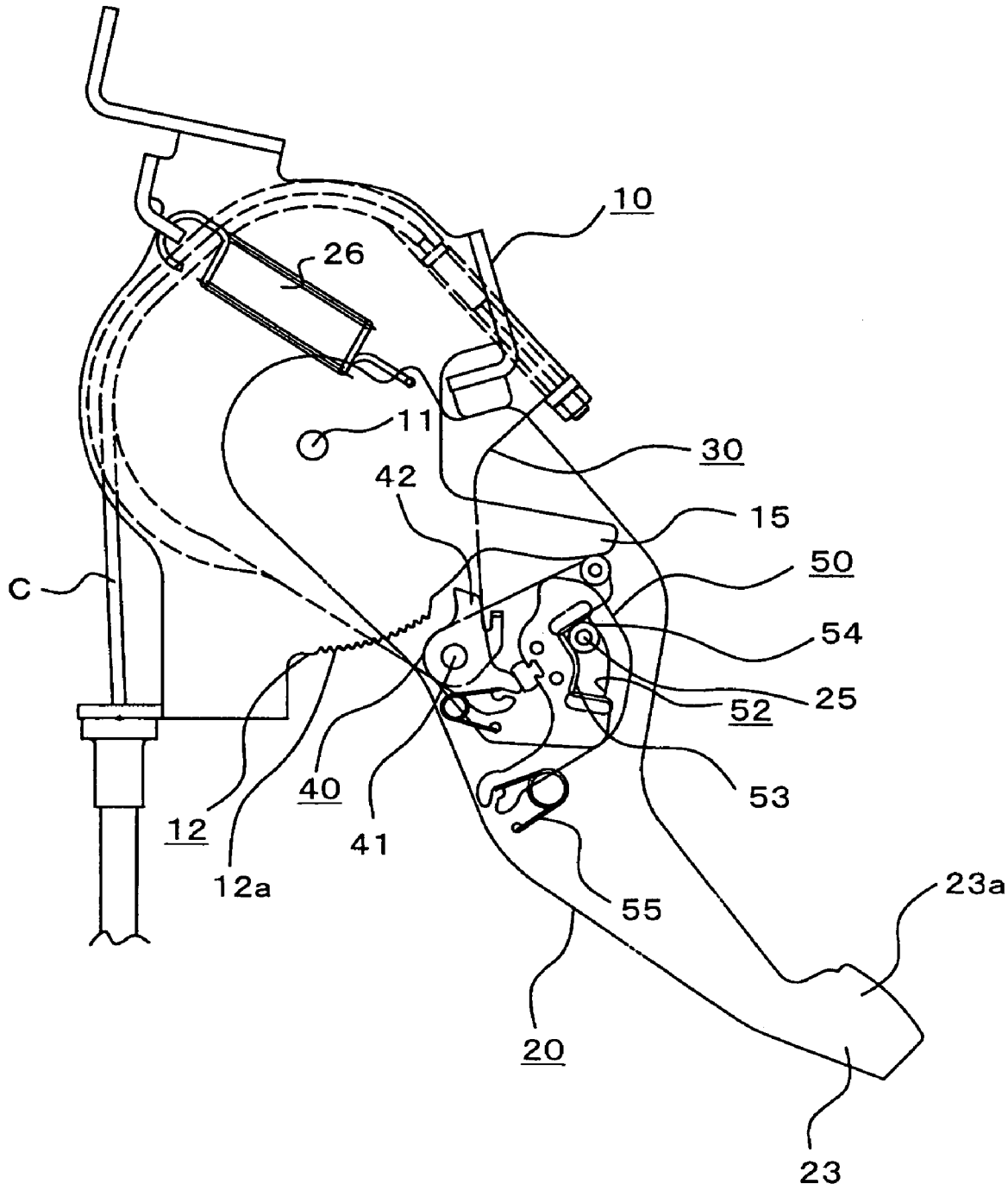
FIG. 3 is a side view illustrating a man-powered braking apparatus according to one embodiment of the present invention that is in the original position before braking.

In other words, when the toe shoe 23*a* in the end part 23 of the braking lever 20 is treaded to apply a force from the original position before braking as shown in FIG. 3, the force is transmitted from the power transmission pin 25 fixedly installed to the base part 21 of the braking lever 20 to the force transmission cam groove 53 of the cam groove 52 in the transmission link member 50, and the force is transmitted to the output link member 30 to which the braking cable C is connected, the output link member 30 being turned around the main support shaft 11 with the braking cable C being pulled.

Figure 4:
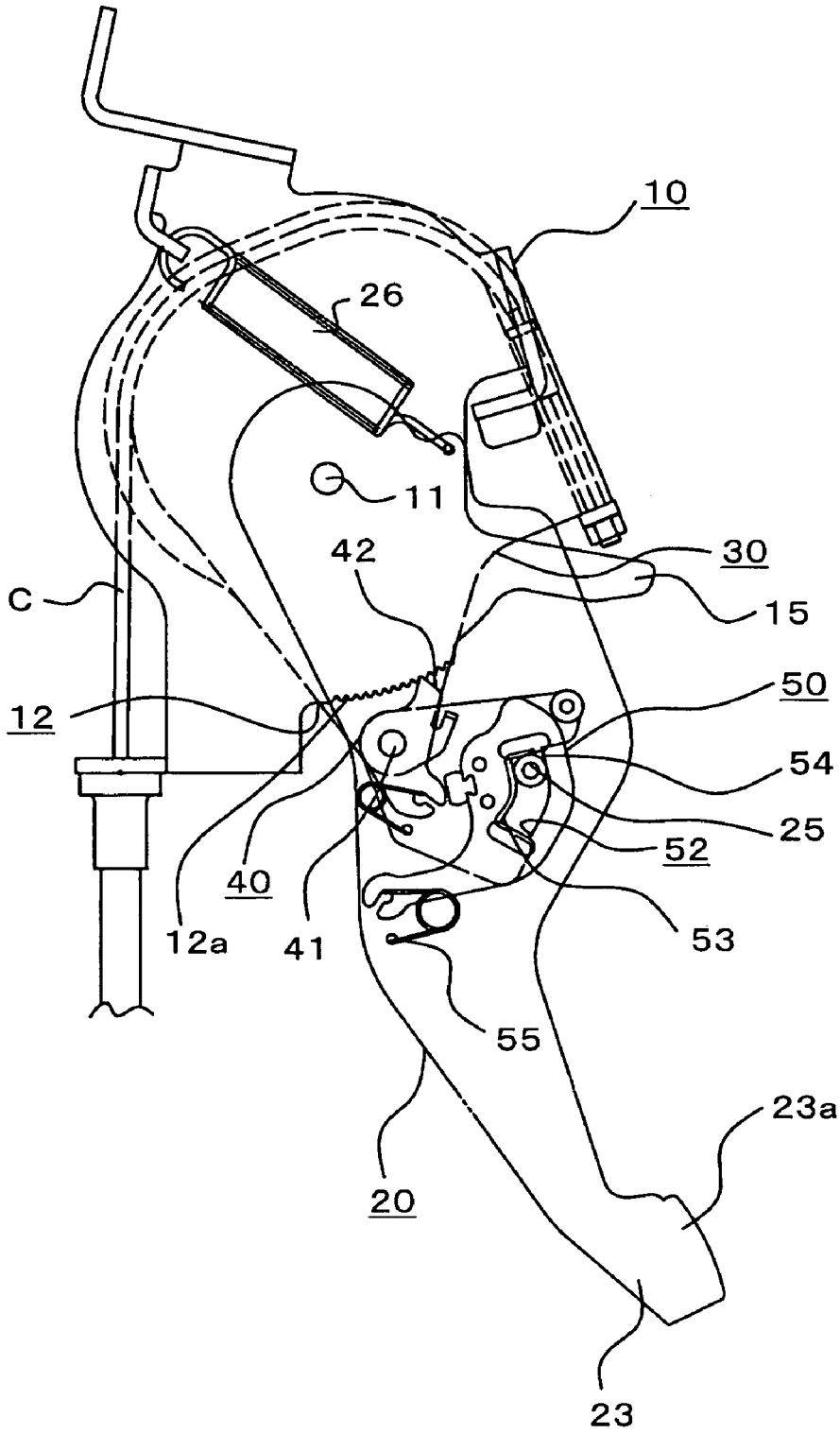
FIG. 4 is a side view illustrating a man-powered braking apparatus according to one embodiment of the present invention that is in the state of the braking being started.
Figure 5:
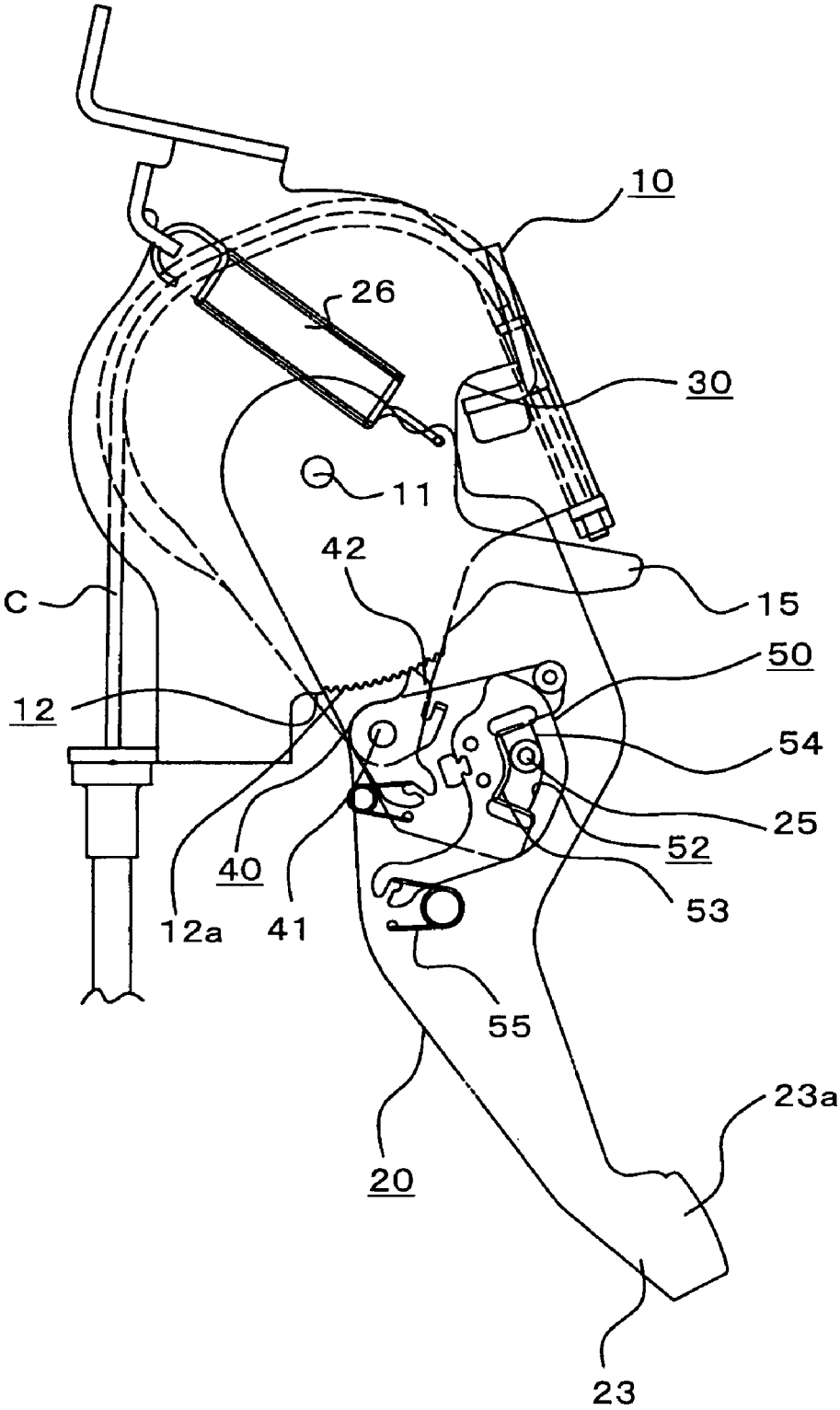
FIG. 5 is a side view illustrating a man-powered braking apparatus according to one embodiment of the present invention that is in the state of the force being started to be removed.

When the output link member 30 is turned as shown in FIG. 4, the pawl member 40, which is pivoted to the output link member 30, is moved, being kept engaged with the teeth 12*a* of the ratchet plate 12, which is fixedly installed to the base 10. Then, in a position where a moderate braking force is provided, removing the force from the end part 23 of the braking lever 20 to release it will cause the pawl member 40 to be kept engaged with the teeth 12*a* at that position for preventing the output link member 30 from being returned, and thus maintaining the braking state, as shown in FIG. 5.

The transmission link member 50 is pivoted to the output link member 30 such that it is capable of being rocked between the braking position and the releasing position, and when a force is applied to the end part 23 of the braking lever 20, the transmission link member 50 is in the braking position. When the toe shoe 23*a* in the end part 23 of the braking lever 20 is released, the braking lever 20 is turned around the main support shaft 11 to be returned toward the releasing position by the force of the return spring 26. And the power transmission pin 25 fixedly installed to the base part 21 of the braking lever 20 is moved, being kept fitted into the cam groove 52 in the transmission link member 50, and is shifted from the force transmission cam groove 53 to the release holding cam groove 54. The braking lever 20 is returned by the amount corresponding to the play for this shift, however, by providing the cam groove 52 with an appropriate geometry, the play can be minimized.

The pawl member 40 is capable of being kept energized by the turnover spring 45 disposed between it and the transmission link member 50 in the direction for being engaged with or disengaged from the teeth 12*a* of the ratchet plate 12, and when a force has been applied to the end part 23 of the braking lever 20 for the first time, the pawl member 40 is energized in the direction for being engaged with the teeth 12*a* of the ratchet plate 12.

Figure 6:
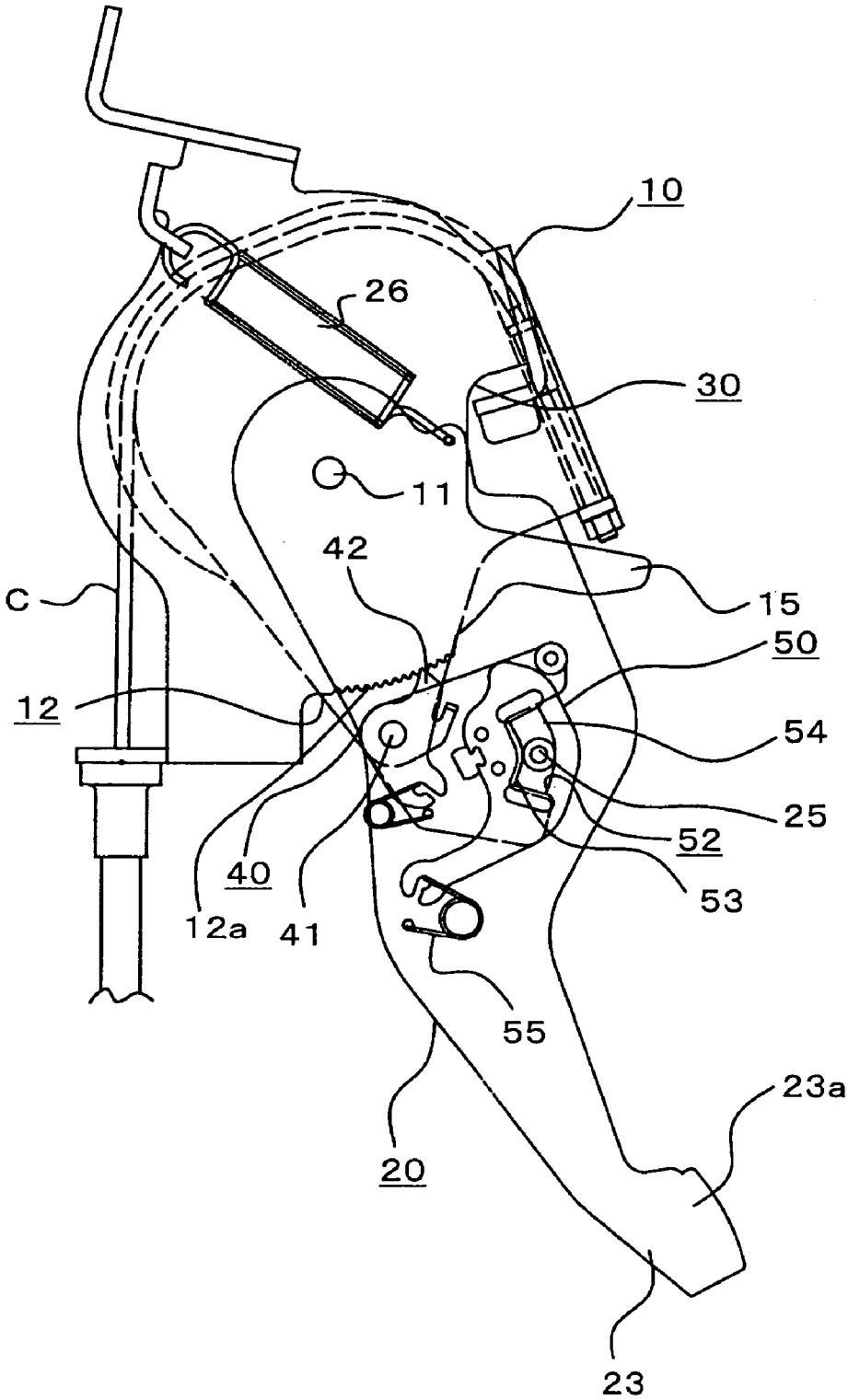
FIG. 6 is a side view illustrating a man-powered braking apparatus according to one embodiment of the present invention that is in the state in which the force is being removed.

When the force applied to the braking lever 20 is removed, the braking lever 20 being returned by the return spring 26, as shown in FIG. 6, the power transmission pin 25 for the braking lever 20 is moved, being kept fitted into the cam groove 52 in the transmission link member 50, and is shifted from the force transmission cam groove 53 to the release holding cam groove 54, the transmission link member 50 being turned to the releasing position.

Figure 7:
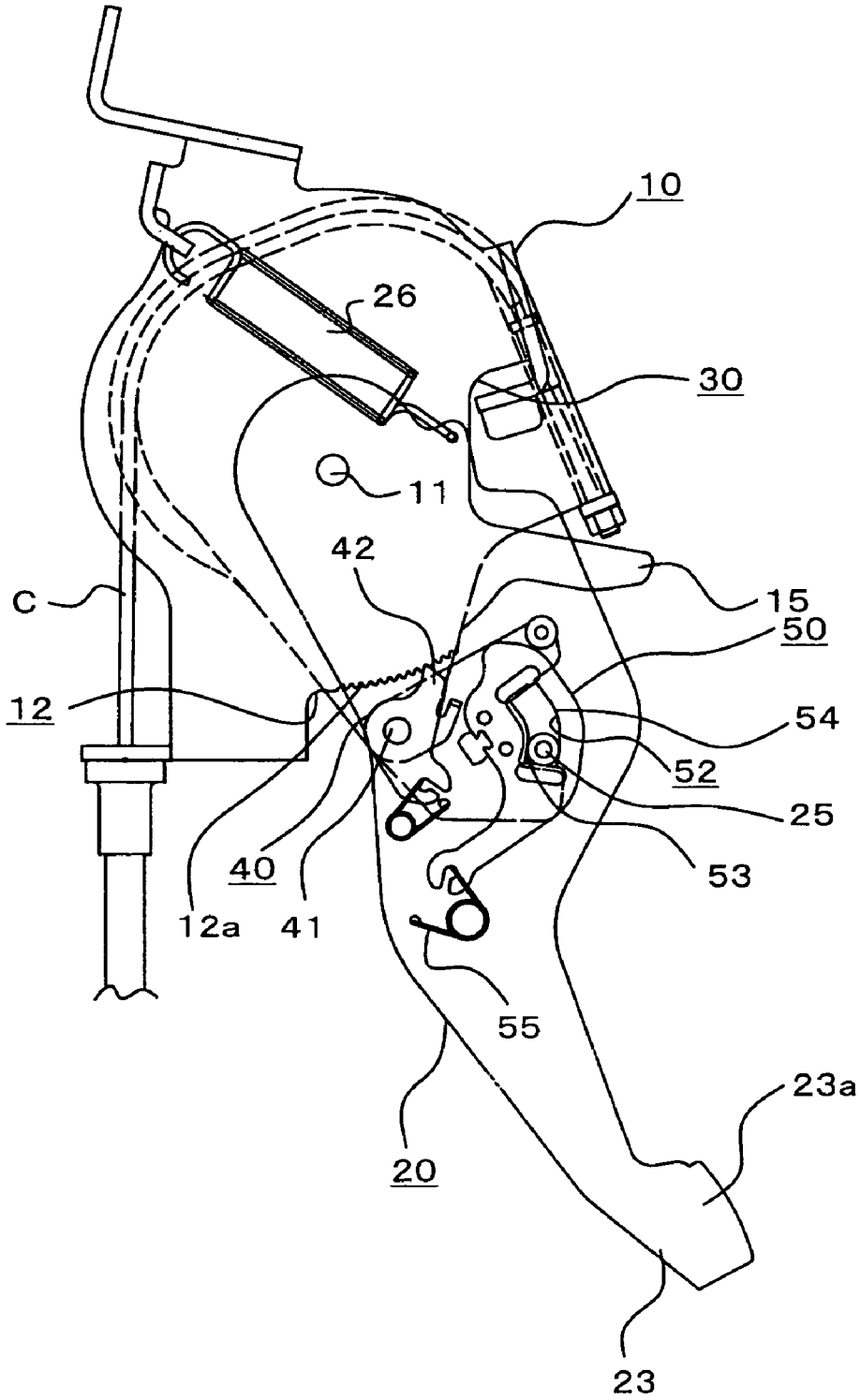
FIG. 7 is a side view illustrating a man-powered braking apparatus according to one embodiment of the present invention with which the braking lever is in the braking state, with the force having been removed.

When the braking lever 20 is fully returned, the turnover spring 45, which has energized the pawl member 40 in the direction for being engaged with the teeth 12*a* of the ratchet plate 12, is inverted such that the pawl member 40 is energized in the direction for being disengaged from the teeth 12*a* of the ratchet plate 12, as shown in FIG. 7. When the pawl member 40 is engaged with the teeth 12*a* of the ratchet plate 12 by the braking force, the pawl member 40 will not be disengaged, being held by the friction force, even if the direction in which the pawl member 40 is energized is inverted.

Thus, when a force is applied to the end part 23 of the braking lever 20, the braking lever C being pulled in accordance with turning of the braking lever 20 for braking, and then the force is removed, the pawl member 40 is engaged with the teeth 12*a* of the ratchet plate 12 to maintain the braking state, and when the braking lever 20 is displaced in the returning direction by the return spring 26, the pawl member 40 is brought into the state in which it is energized in the direction for being disengaged from the teeth 12*a* of the ratchet plate 12 while the braking state being maintained.

Figure 8:
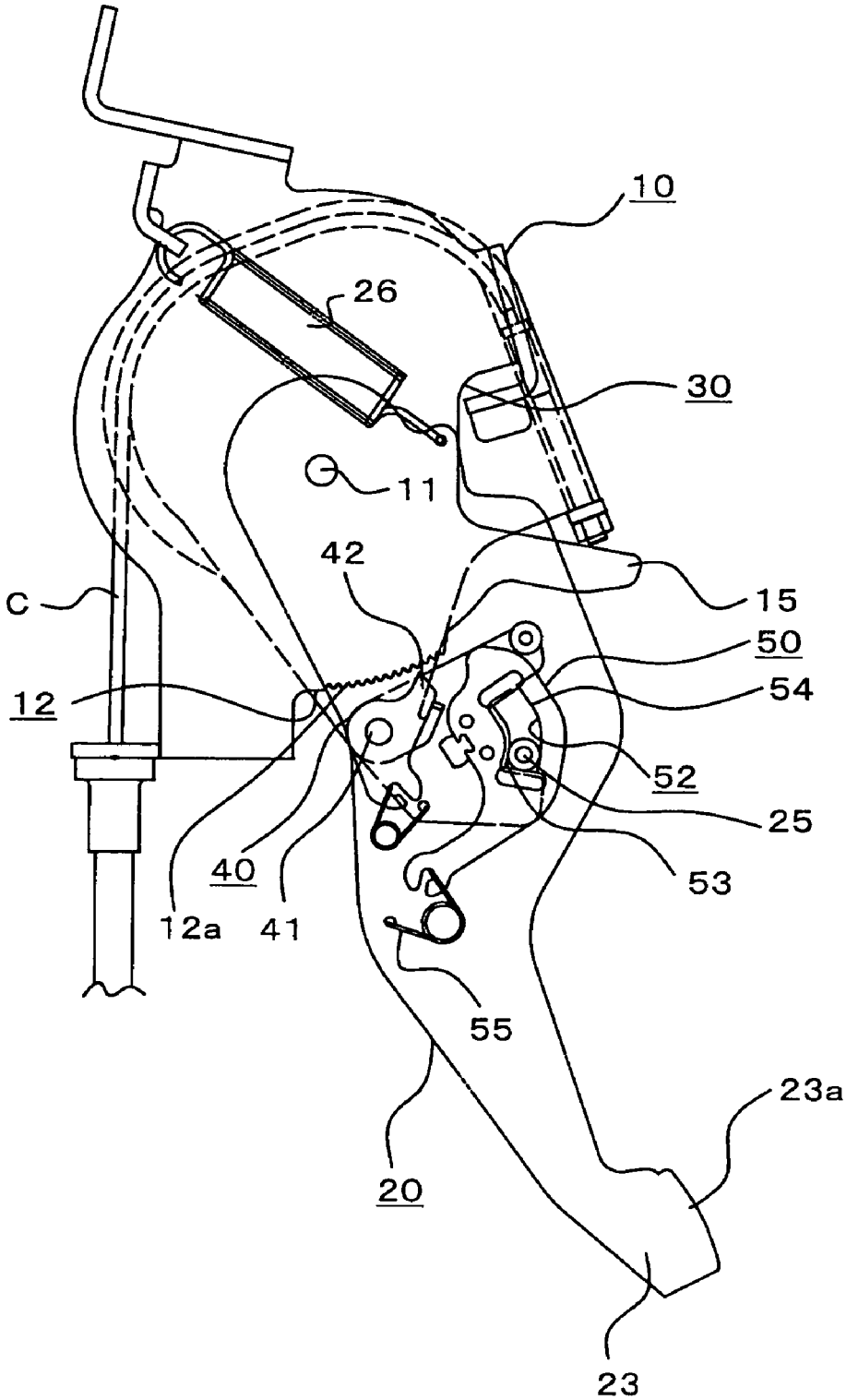
FIG. 8 is a side view illustrating a man-powered braking apparatus according to one embodiment of the present invention that is in the state of releasing the brake being started.

Then, when a force is once applied to the braking lever 20 for releasing the brake from the braking state, the friction between the pawl end 42 of the pawl member 40 and the teeth 12*a* of the ratchet plate 12 is eliminated, and the pawl member 40 is disengaged from the teeth 12*a* of the ratchet plate 12 by the energizing force of the inverted turnover spring 45, as shown in FIG. 8.

Figure 9:
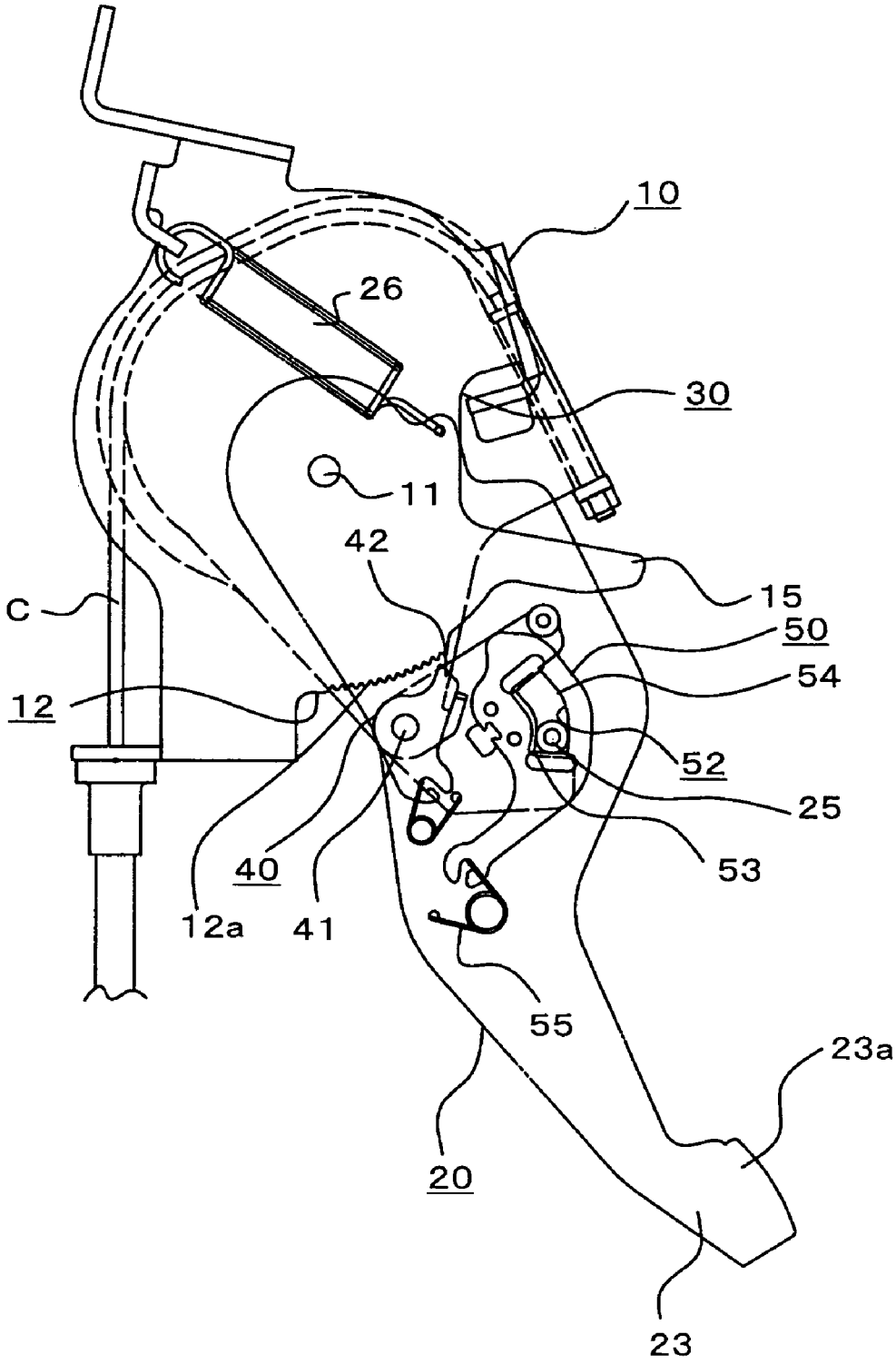
FIG. 9 is a side view illustrating a man-powered braking apparatus according to one embodiment of the present invention that is in the state in which the force is being removed.
Figure 10:
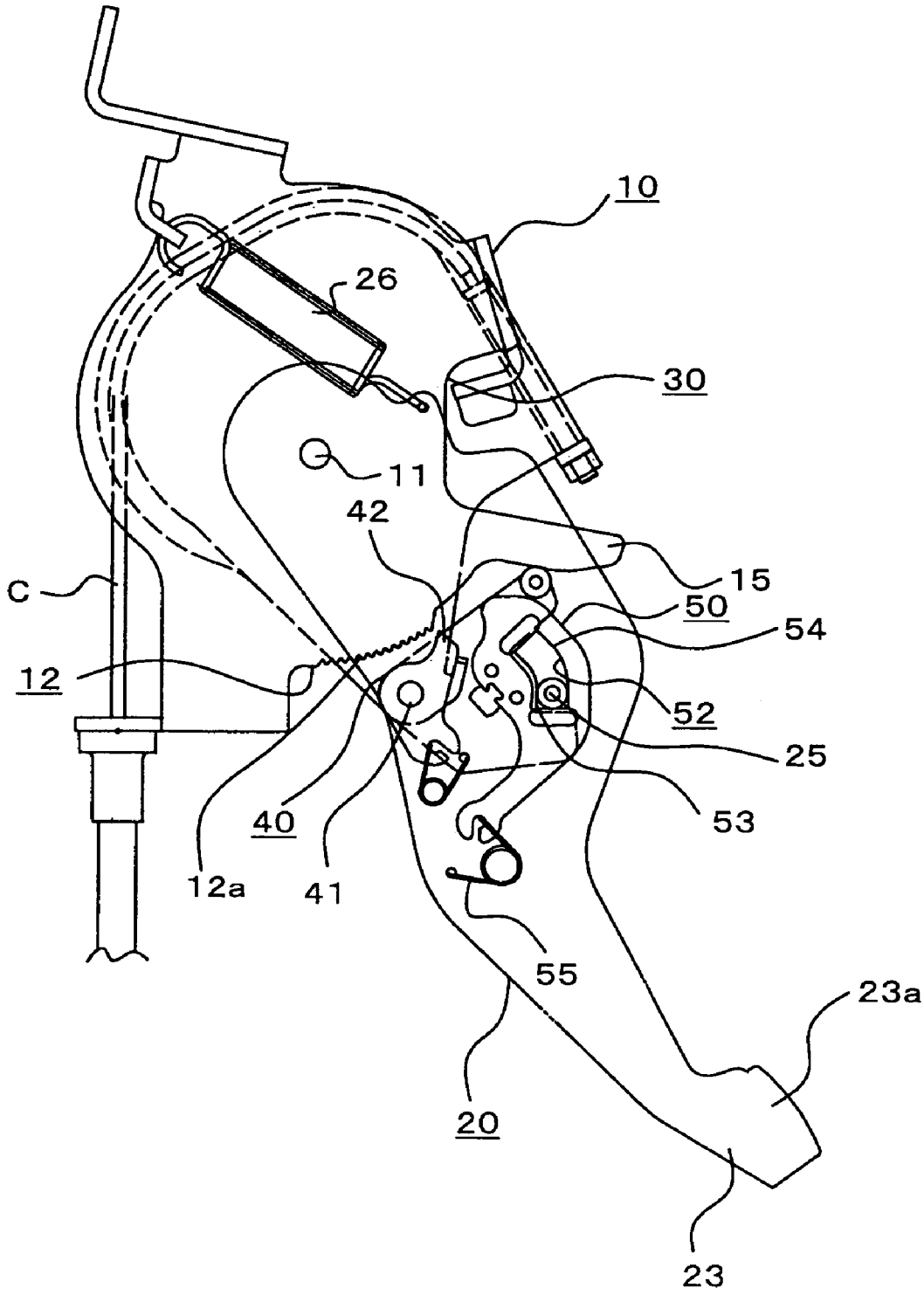
FIG. 10 is a side view illustrating a man-powered braking apparatus according to one embodiment of the present invention that is in the state in which the force is being removed.
Figure 11:
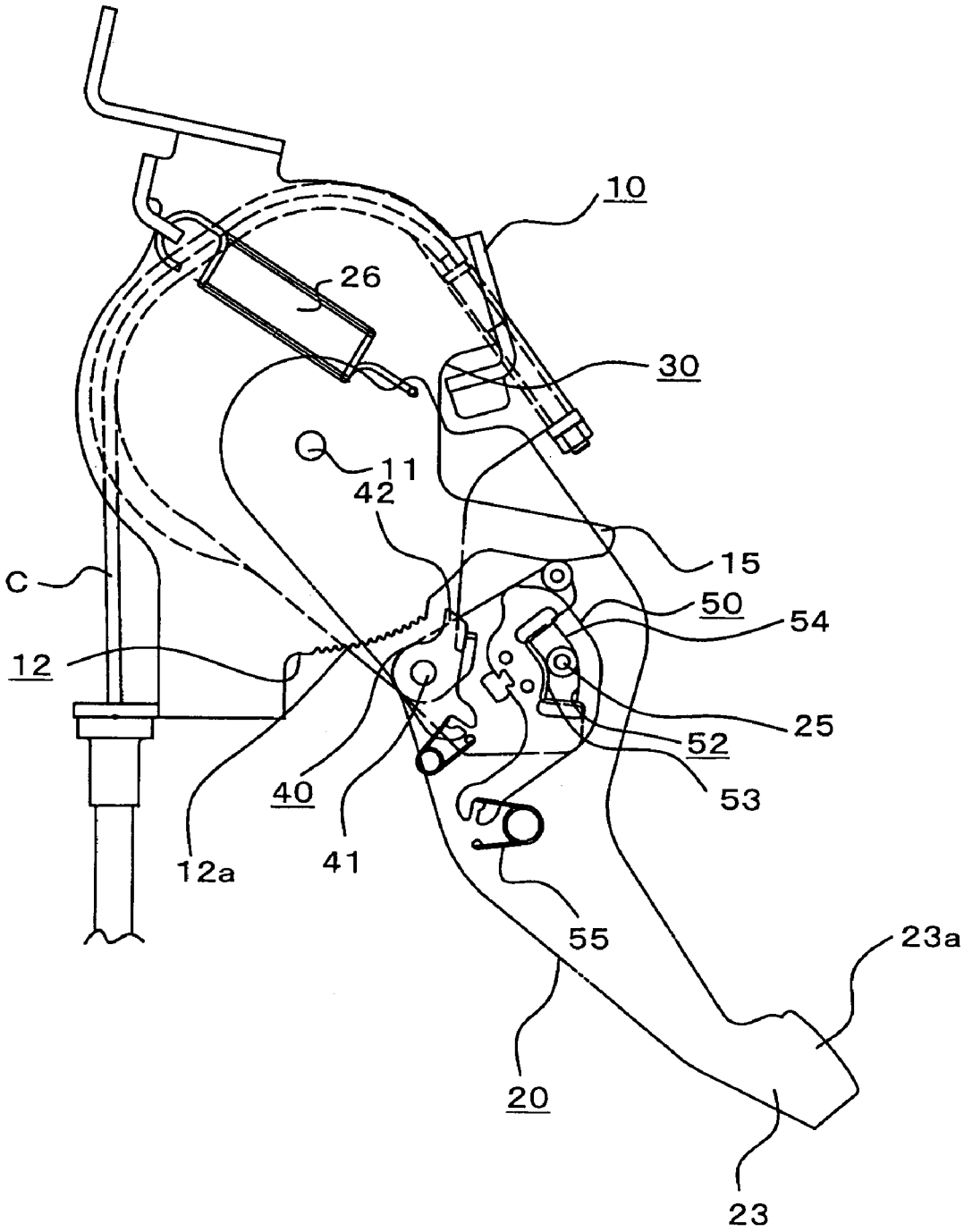
FIG. 11 is a side view illustrating a man-powered braking apparatus according to one embodiment of the present invention that is in the original position in the brake released state with the force having been removed.

Then, removing the force at that point allows the braking lever 20 and the output link member 30 to be turned in the brake releasing direction for releasing the brake, as shown in FIG. 9 and FIG. 10. When the braking lever 20 is returned to the original position, the return pin 56 of the transmission link member 50 is butted against the return end 15 provided as a part of the base 10, the transmission link member 50 being also returned to the braking position as the original position, as shown in FIG. 11.

In one embodiment in which the braking cable C is connected to the output link member 30, being wound thereon, the braking cable C is smoothly pulled by the circumference of the output link member 30 for generation of the braking force. In one embodiment in which the transmission link member 50 is pivoted to the output link member 30 coaxially with the pawl member 40, the linking is simplified, which results in easier layout.

In one embodiment in which the assist spring 55, which causes the transmission link member 50 to be turned to the releasing position, is provided, the transmission link member 50 is positively turned from the braking position to the releasing position. In one embodiment in which the braking lever 20 is of treadle-powered type, foot, which is rather inconvenient, as compared to hand, can be used to apply a force to the end part 23 for the proper operation of the man-powered braking apparatus 1.

With the man-powered braking apparatus according to the present invention, the transmission link member is rocked to switch over between the braking position and the releasing position, and the cam groove determines the positional relationship, thus smooth and positive operation is assured.

What is claimed is:

1. A man-powered braking apparatus with which one end part of a braking lever is rockably pivoted to a base fixed to a car body; the other end part of the braking lever is disposed to be operatable by pushing of an operator; and brake is applied by exerting a force on the other end part thereof for pulling a braking cable in accordance with turning of the braking lever, wherein an output link member to which the braking cable is connected is pivoted to said base coaxially with said braking lever; a pawl member which is engaged with teeth of a ratchet plate fixedly installed to said base to maintain the braking state is pivoted to the output link member; a transmission link member is disposed between said braking lever and said output link member;

said output link member is pushed by the braking lever through said transmission link member, being turned in one direction from the non-braking position to pull the braking cable connected to the output link member for generation of a braking force;

said transmission link member is pivoted to said output link member such that it is capable of being rocked between the braking position and the releasing position, and has a cam groove which is fitted with a power transmission pin fixedly installed to the braking lever;

said pawl member is capable of being kept energized by a turnover spring disposed between it and said transmission link member in the direction for being engaged with or disengaged from the teeth of said ratchet plate;

the cam groove in said transmission link member has a force transmission cam groove portion which is formed such that, when the transmission link member is in the braking position, the force which is applied to the other end part of said braking lever can be transmitted to said output link member, and a release holding cam groove portion which, when the force applied to said braking lever is removed, and the braking lever is returned by a return spring, causes said transmission link member to be turned to the releasing position, and said turnover spring, which has energized said pawl member in the direction for being engaged with the teeth of said ratchet plate, to be inverted such that said pawl member is energized in the direction for being disengaged from the teeth of said ratchet plate;

said power pin transmission pin and said cam groove are arranged so that when a force is applied to the other end part of the braking lever, the force is applied from the power transmission pin fixed to the braking lever to the force transmission cam groove portion of the cam groove in the transmission link member, and when the braking lever is released, the braking lever tries to return in a releasing direction by a force of the return spring, and the power transmission pin fixed to the braking lever moves from the force transmission cam groove portion to the release holding cam groove portion while the power transmission pin fits in the cam groove in the transmission link member;

when a force is applied to the other end part of said braking lever for pulling the braking cable in accordance with turning of the braking lever to operate the brake, and then the force is removed, the pawl member engages with the teeth of the ratchet plate to maintain the braking state; when the braking lever is displaced in the returning direction by the return spring, the pawl member is brought into the state in which it is energized in the direction for being disengaged from the teeth of said ratchet plate while the braking state being maintained; then, when a force is once applied to the braking lever for releasing the brake, the pawl member is disengaged from the teeth of said ratchet plate; and then when the force is removed, the braking lever and said output link member are turned in the brake releasing direction for releasing the brake.

2. The man-powered braking apparatus of claim 1, wherein an assist spring is provided for turning said transmission link member to the releasing position.

3. The man-powered braking apparatus of claim 1, wherein said braking lever is that with which a force is applied by treading on the other end part.

4. The man-powered braking apparatus of claim 1, wherein said cam groove is formed in a curved shape having two end portions, said force transmission cam groove portion being situated near one of the two end portions, said release holding cam groove portion being situated near the other of the two end portions.

5. A man-powered braking apparatus with which one end part of a braking lever is rockably pivoted to a base fixed to a car body; the other end part of the braking lever is disposed to be operatable by pushing of an the operator; and brake is applied by exerting a force on the other end part thereof for pulling a braking cable in accordance with turning of the braking lever, wherein an output link member to which the braking cable is connected is pivoted to said base coaxially with said braking lever; a pawl member which is engaged with teeth of a ratchet plate fixedly installed to said base to maintain the braking state is pivoted to the output link member; a transmission link member disposed between said braking lever and said output link member is pivoted to the output link member coaxially with the pawl member;

said output link member is pushed by the braking lever through said transmission link member, being turned in one direction from the non-braking position to pull the braking cable connected to the output link member, being wound thereon, for generation of a braking force;

said transmission link member is pivoted to said output link member such that it is capable of being rocked between the braking position and the releasing position, and has a cam groove which is fitted with a power transmission pin fixedly installed to the braking lever;

said pawl member is capable of being kept energized by a turnover spring disposed between it and said transmission link member in the direction for being engaged with or disengaged from the teeth of said ratchet plate;

the cam groove in said transmission link member has a force transmission cam groove portion which is formed such that, when the transmission link member is in the braking position, the force which is applied to the other end part of said braking lever can be transmitted to said output link member, and a release holding cam groove portion which, when the force applied to said braking lever is removed, and the braking lever is returned by a return spring, causes said transmission link member to be turned to the releasing position, and said turnover spring, which has energized said pawl member in the direction for being engaged with the teeth of said ratchet plate, to be inverted such that said pawl member is energized in the direction for being disengaged from the teeth of said ratchet plate;

said power transmission pin and said cam groove are arranged so that when a force is applied to the other end part of the braking lever, the force is applied from the power transmission pin fixed to the braking lever to the force transmission cam groove portion of the cam groove in the transmission link member, and when the braking lever is released, the braking lever tries to return in a releasing direction by a force of the return spring, and the power transmission pin fixed to the braking lever moves from the force transmission cam groove portion to the release holding cam groove portion while the power transmission pin fits in the cam groove in the transmission link member;

when a force is applied to the other end part of said braking lever for pulling the braking cable in accordance with turning of the braking lever to operate the brake, and then the force is removed, the pawl member engages with the teeth of the ratchet plate to maintain the braking state; when the braking lever is displaced in the returning direction by the return spring, the pawl member is brought into the state in which it is energized in the direction for being disengaged from the teeth of said ratchet plate while the braking state being maintained; then, when a force is once applied to the braking lever for releasing the brake, the pawl member is disengaged from the teeth of said ratchet plate; then when the force is removed, the braking lever and said output link member are turned in the brake releasing direction for releasing the brake; and then when the braking lever is returned to the original position, said transmission link member is butted against a part of said base, being also returned to the original position.

6. The man-powered braking apparatus of claim 5, wherein an assist spring is provided for turning said transmission link member to the releasing position.

7. The man-powered braking apparatus of claim 5, wherein said braking lever is that with which a force is applied by treading on the other end part.

8. The man-powered braking apparatus of claim 5, wherein said cam groove is formed in a curved shape having two end portions, said force transmission cam groove portion being situated near one of the two end portions, said release holding cam groove portion being situated near the other of the two end portions.

9. A man-powered braking apparatus comprising:

a braking lever rotatably connected to a base fixed to a car body, said braking lever including a power transmission pin;

an output link member connected to the braking cable;

a pawl member engaging a ratchet plate fixed to the base to hold the output link member in a braking state;

a turnover spring for urging the pawl member to engage or disengage with respect to the ratchet plate; and a transmission link member disposed between the braking lever and the output link member, said transmission link member including a cam groove for retaining the power transmission pin, said cam groove having a force transmission cam groove portion for transmitting a force from the braking lever to the output link member when the power transmission pin is situated in the force transmission cam groove portion, and a release holding cam groove portion for disengaging the pawl member from the ratchet plate when the power transmission pin is situated in the release holding cam groove portion.

10. The man-powered braking apparatus of claim 9, wherein said cam groove is formed in a curved shape having two end portions, said force transmission cam groove portion being situated near one of the two end portions, said release holding cam groove portion being situated near the other of the two end portions.

11. The man-powered braking apparatus of claim 9, wherein said output link member is arranged to wind the braking cable thereon.

* * * * *